United States Patent [19]

Glucksman

[11] Patent Number: 4,767,914

[45] Date of Patent: Aug. 30, 1988

[54] ELECTRIC HAIRDRYER HAVING A CAGE-SHAPED HEATER ELEMENT

[76] Inventor: Dov. Z. Glucksman, 462 Boston St., Topsfield, Mass. 01983

[21] Appl. No.: 907,994

[22] Filed: Sep. 16, 1986

[51] Int. Cl.[4] ..... H05B 1/02; H05B 3/00; A45D 20/10; A45D 20/38

[52] U.S. Cl. ..... 219/370; 34/97; 34/243 R; 219/364; 219/367; 219/375; 219/376

[58] Field of Search ..... 219/369–371, 219/374–376, 366; 34/96–101, 243 R

[56] References Cited

U.S. PATENT DOCUMENTS

| | | | |
|---|---|---|---|
| 2,158,603 | 5/1939 | Calhoun | 219/375 X |
| 4,039,774 | 8/1977 | Kata et al. | 219/370 |
| 4,066,865 | 1/1978 | Godel et al. | 219/370 |
| 4,197,448 | 4/1980 | Harigai | 219/370 |
| 4,328,818 | 5/1982 | Glucksman | 219/370 X |
| 4,350,872 | 9/1982 | Meywald et al. | 219/376 |
| 4,647,757 | 3/1987 | Haastrup | 219/370 |

FOREIGN PATENT DOCUMENTS

| | | | |
|---|---|---|---|
| 2090480 | 7/1982 | United Kingdom | 219/370 |

*Primary Examiner*—Anthony Bartis

*Attorney, Agent, or Firm*—John S. Roberts, Jr.; William J. Bundren

[57] ABSTRACT

A hair dryer with a frusto-conical casing tapering from a larger rear air inlet end to a smaller air outlet end contains in coaxial alignment therewith in an electric heater element shaped as a cylindrical open-ended cage and an electric motor extending partly into the cage and driving axial fan positioned rearwardly of the cage. The cage consists of series connected spaced parallel metal strips held by electrically non-conductive end rings and inclined to the cage circumference to form air guide vanes. The cage divides the casing space into an annular outer duct decreasing in cross section toward its front end and closed by contact with the casing and an annular inner duct between the cage and motor. Part of the air from the fan flows through the outer duct and through the vanes to the cage interior while the remainder flows through the inner space to cool the motor. The two air streams mix to the required temperature in the cage interior downstream of the motor for discharge through the air outlet. The heater element may comprise a pair of same diameter cages arranged end to end or a pair of nested inner and outer cages with the pairs of cages being energizable separately or in parallel.

7 Claims, 3 Drawing Sheets

ELECTRIC HAIRDRYER HAVING A CAGE-SHAPED HEATER ELEMENT

BACKGROUND OF THE INVENTION

The invention relates to a hairdryer comprising an axial fan and a cage-shaped electrically energized resistor for heating the air blown through the apparatus by the axial fan.

Most conventional hair dryers comprise a heating element composed of resistance wires or ribbons and a motor-driven fan blowing air in axial direction through the heating element. In some of these hair dryers the fan motor is placed close to or inside the heating element and, in order to prevent its overheating, the motor is surrounded by a shield of mica or another heat-resistant material.

U.S. Pat. No. 4,328,818 discloses a hair dryer of a design completely departing from the former conventional construction. Herein the hair dryer comprises a cage-shaped resistor and a motor-driven axial fan enclosed in an oblong casing of circular cross section. The fan sucks in air through circumferential inlet openings and blows it through the cage from its outside periphery into its interior, and from there through outlet slots into a cylindrical brush attached to the front of the casing.

The fan is of much larger diameter than the outer diameter of the resistor cage, and the portion of the casing surrounding the fan and most of the resistor cage is enlarged in bulbous shape, defining an annular air duct of gradually decreasing cross section around the case periphery. The shape of the duct results in an air flow of relatively low axial velocity and causes its diversion through the cage blades in substantially uniform distribution over the entire circumference of the heater.

The cage-shaped resistor contains a plurality of parallel, axially extending thin blades which are curved and inclined in respect of the peripheral surface of the cage to effect maximal heating efficiency while straightening the air flow which emerges in spiral direction from the axial fan impeller before entering the heater.

The electric motor, the fan, and the resistor are arranged in line, the motor being positioned in the space of the casing which is perforated by the inlet openings, the resistor cage at the other end just in front of the air outlet openings leading to the cylindrical brush, while the fan impeller is mounted on the motor shaft and located between the motor and the cage.

Although the total longitudinal extent of the three components is relatively large, they fit readily into the oblong casing and the coaxial handle portion; however, in a conventional, pistol-shaped hair dryer composed of a substantially cylindrical main casing portion with a downwardly extending handle portion, it would require a rather long main portion causing the hair dryer to be heavy and unwieldy. This is a drawback which to obviate is one of the objects of the present invention.

Another drawback of the hair dryer of the aforementioned patent, U.S. Pat. No. 4,328,818, lies in the fact that the power settings of the resistor cannot be adjusted, since all vanes of the cage are connected in series. The air temperature is only controllable by suitably changing the motor revolutions, in a known manner, whereby more or less air is blown by the fan through the resistor and is accordingly heated to a lower or higher temperature, respectively.

The present invention has, therefore, the main object of providing a hair dryer of a more compact build and lighter weight than the existing, conventional hair dryers, while employing air moving and heating means substantially identical with those described in my previous patent but in a different manner of arrangement designed to obtain this object.

It is an additional object, not obtained with my previous hair dryer in U.S. Pat. No. 4,328,818, to provide means for heating the cage to at least two different settings of temperature to be selected by the user.

And it is a further object to provide a hair dryer with a low flow resistance in order to obtain the required heating effect and air flow by means of a relatively small-diameter fan impeller and an accordingly small-wattage motor.

SUMMARY OF THE INVENTION

The hair dryer of the present invention comprises a cylindrical or slightly tapering casing provided with a hand grip, the casing containing a heating element in the shape of a hollow cylindrical cage which is composed of a plurality of parallel strips of thin metal sheeting inclined to the circumference of the cage; the strips are connected in series at alternate ends and serve both as electrical resistors and as guide vanes for the air passing through the cage from its outside to its inside. It further contains an axial fan impeller mounted on the shaft of an electric motor and positioned upstream of the resistor cage. The fan serves to draw air in through air inlet ports at one end, the "rear" end, of the casing and to blow it out through outlet ports at the other, the "front" end of the casing, after it has been heated by the heating element. The hair dryer is characterized by an electric motor mounted downstream of the fan impeller, and extending for over half its length into the inner space of the heater cage. The other characteristic feature is the arrangement of the air ducts in such a manner that a portion of the air delivered by the fan impeller is blown directly into the inner cage space—without being blown through and heated by the vanes—and guided over the outer surface of the electric motor, thereby cooling it. The larger portion of air is guided through and heated by the energized vanes, by being blown through the cage from the outside to the inside, and is mixed with the cool air before exiting through the outlet ports at a suitable temperture.

In a preferred embodiment, the resistor cage is doubled; i.e., two cages are positioned in close alignment, one behind the other, while each cage is adapted to be separately energized.

In another embodiment provided with a resistor cage of a given length and diameter, a second cage of the same length but of smaller diameter is inserted into the first, cage and adapted to be separately energized.

By judiciously selecting the ohmage of the first and the second cages, in each of the above-mentioned embodiments, three stages of heating are made possible, by either energizing one of the two cages or both cages simultaneously.

The casing is either cylindrical with substantially flat front and rear covers, each perforated by respective air inlet and outlet openings, or it is slightly tapering from rear to front which serves to create a forwardly tapering annular space between the casing inside wall and the outside of the heater cage.

The resistor cage is cut and stamped out of a thin resistor metal sheet, and each strip is formed into curved and inclined shape. The thus-prepared sheet is wrapped around two end rings of a nonconductive plastic material and fastened thereto by means of holes in the end portions connecting each two strips which engage with cogs protruding out of the circumference of the end rings. With two separate cages, each cage is mounted on separate end rings; or in the case of two lengthwise adjoining cages, these may be mounted on two end rings and one double-cogged center ring.

A grip is integral with the main casing and contains the cord connection and a switch with as many positions as necessary for energizing the electric motor and the resistor or resistors.

BRIEF DESCRIPTION OF THE FIGURES

With reference to FIGS. 1 and 2, a hair dryer casing comprises a front housing consisting of a frustoconical part 1 including the front portion 1' of a handle, and a rear housing comprising a frusto-conical portion 2 (in continuation of the part 1) and the rear portion 2' of the handle. A front cover 3 is clampedly fastened to the front housing and is perforated by a plurality of air outlet ports 23. The rear housing is closed by a rear cover 4, likewise perforated by air inlet ports 24. The front and the rear housing are assembled so as to form a closed casing, by closure means as known to the art. The front housing comprises a motor cradle 21 in the form of a hollow cylinder concentrically held in the housing by radial ribs 31, which also serve as means for guiding the air, the cradle is extended to the front in the shape of a tongue 25, perforated and provided with brass eyelets 18 for wiring and supporting a safety thermostat 10.

Figure 2:
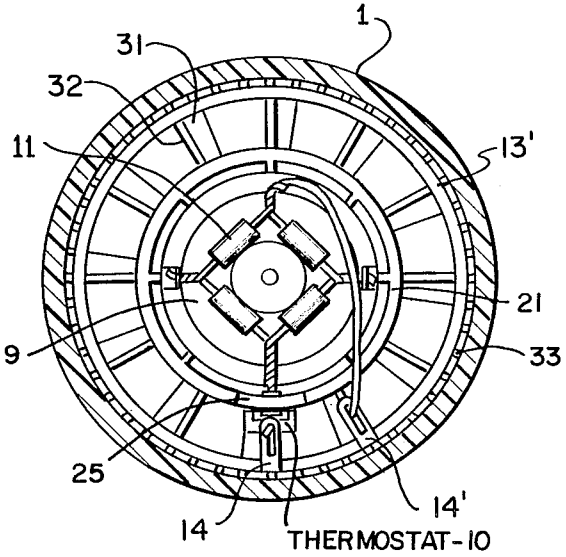
FIG. 2 is a seciton along 2—2 of FIG. 1.

The thermostat 10 is located near the motor 9 and is in axial alignment thereof in order to assure that during normal operation the thermostat is always being cooled by the air stream which by-passes the heater. This allows the use of a thermostat which is set to open at a very low temperature (80°–90° C.). Therefore, the instant that the air flow is being blocked or the fan is stalled, the thermostat will sense a higher temperature and will open the circuit, thus preventing any fire hazard.

An electric motor 9 is firmly held in the cradle 21, its long shaft 17 extending in rearward direction and having affixed to it an axial fan impeller 8.

A resistor cage 12 consisting of a plurality of parallel spaced-apart metal strips connected at alternate ends by bridging portions is attached to and held in position by two non-conductive end rings 13 and 13'. The strips are inclined to the ideal circumferential surface of the cage and serve both as resistance heater elements and as guide vanes for the air passing through the cage from its outside to its inside. The bridging portions are perforated and the perforations engage with a plurality of cogs 33 which project out of the circumference of the two end rings 13 and 13'. The entire cage is held in the frontal housing by extended ribs 32 which are an integral part of the radial ribs 31.

The characteristic feature of the present hair dryer is the positioning of the electric motor 9 inside the heater cage 12, thereby considerably reducing the total length of the casing. In order to prevent overheating of the electric motor, cool air is blown along the motor periphery by the axial fan impeller through an inner annular space 26 remaining between the outside of the motor cradle 21 and the inside of the rear end ring 13.

The annular space is nozzle-shaped, and the air passing through creates a low-pressure zone inside the cage, thereby increasing the pressure differential between the outer circumference and the inside of the resistor cage and assisting the through-flow of air between the vanes of the cage. The greater part of the air which is to be heated is blown by the impeller through an outer annular space 27, situated between the outside of the end ring 13' and the inside of the frontal housing 1. The cross section of the annular space decreases in frontal direction due to the converging walls of the front housing, and outside air is conveyed into the cage interior between the spaced, heated strips of the cage and is heated to the required temperature. The heated air mixes with the cool air entering the cage interior via the annular space 26, and the mixed air leaves the hair dryer through the outlet ports 23 in the front cover 3.

Due to the relatively small inside diameter of the casing, the annular duct between cage and casing wall is of small cross section, causing an axial flow of high velocity. The low pressure zone created by the nozzle-shaped annular space 26 forces the air through the vanes, while without this arrangement almost no air would flow through that part of the vanes closest to the fan impeller, thus causing overheating of this area, on the one hand, and increased pressure losses by non-uniform air flow.

An additional advantage of this arrangement is the fact that the total flow resistance is less than with a conventional hair dryer wherein the entire air volume is driven through the heating element. The flow resistance to the portion of the air passing through the gap 26 is relatively low, while the pressure loss in the vanes of the cage is of similar magnitude, since the air velocity is small due to the smaller air volume passing through the vanes.

The heating element is also provided with integral solder-tabs, two tabs 14 and 14' are located on the front ring 13' and one tab 15 on the rear ring 13. The tabs are provided witth an elongated opening into which lead wires can be placed and readily soldered to energize the heater and to connect the heater to the motor. As can be seen, the low voltage D.C. motor is connected through a full wave rectification bridge consisting of four diodes 11 to the tabs 14 and 14' where the voltage difference beetween 14 and 14' is only 15 volts.

It will be realized that the afore-described embodiment affords the user only one choice of the air temperature, since all cage vanes are connected in series.

Figure 3:
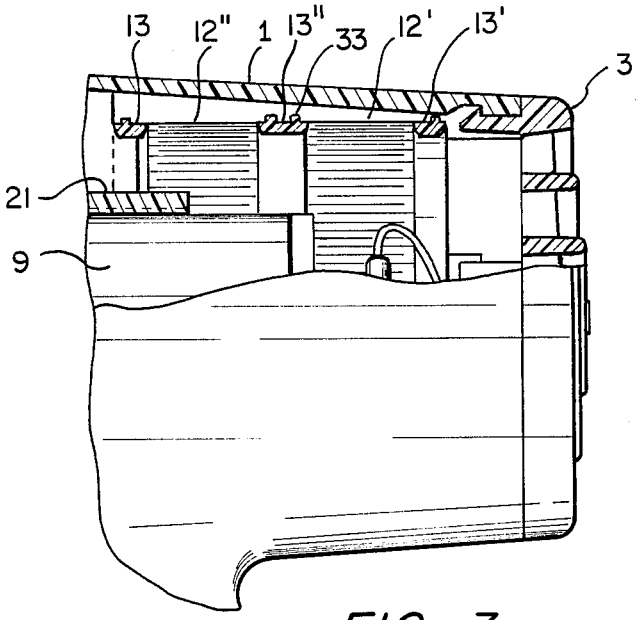
FIG. 3 is a longitudinal section through a portion of another embodiment of the hair dryer provided with a double-layer cage.
Figure 4:
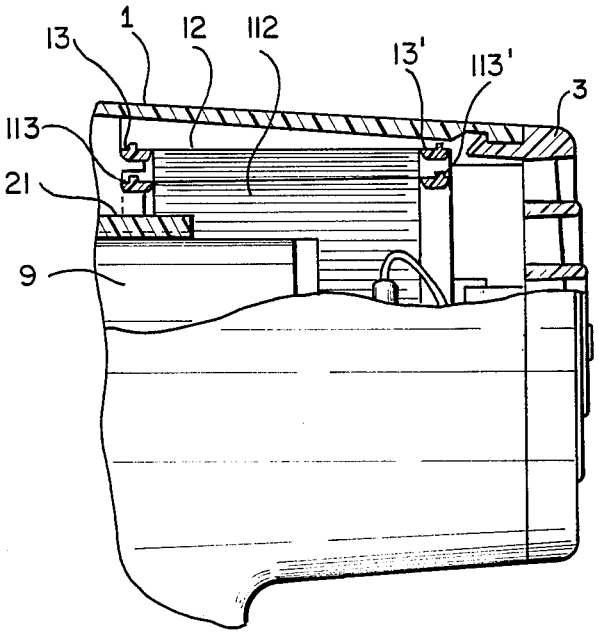
FIG. 4 is a longitudinal section through a portion of still another embodiment of the hair dryer provided with a double-layer cage.

This drawback is remedied by the embodiments shown in FIGS. 3 and 4. The hair dryer in both these embodiments is identical with that shown and described in FIGS. 1 and 2, except for the heater cage and the electric connections thereto.

Figure 1:
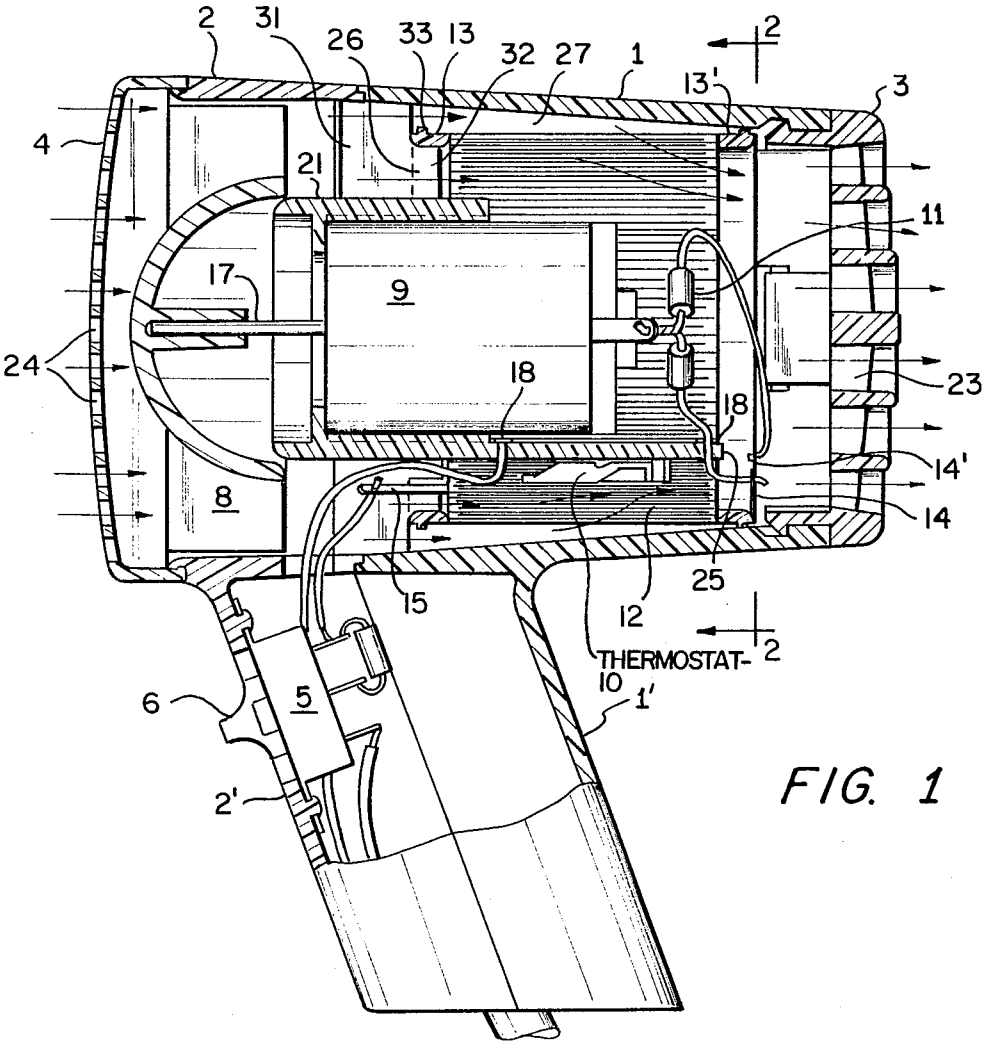
FIG. 1 is a longitudinal section through one embodiment of the hair dryer according to the invention.

The cage shown in FIG. 3 consists of two cages of the same diameter as the cage illustrated in FIGS. 1 and 2. It comprises a frontal cage 12' mounted on a frontal end ring 13' and on a front row of cogs 33 protruding out of the central ring 13''. It also comprises a rear cage 12'' mounted on a rear end ring 13 and the rear row of the cogs 33 protruding out of the central ring 13''. The two cages may be of identical length providing two selections of heating magnitude, or of different length, which would allow three different magnitudes of heating by alternatively energizing one of the cages or both cages simultaneously.

Figure 5:
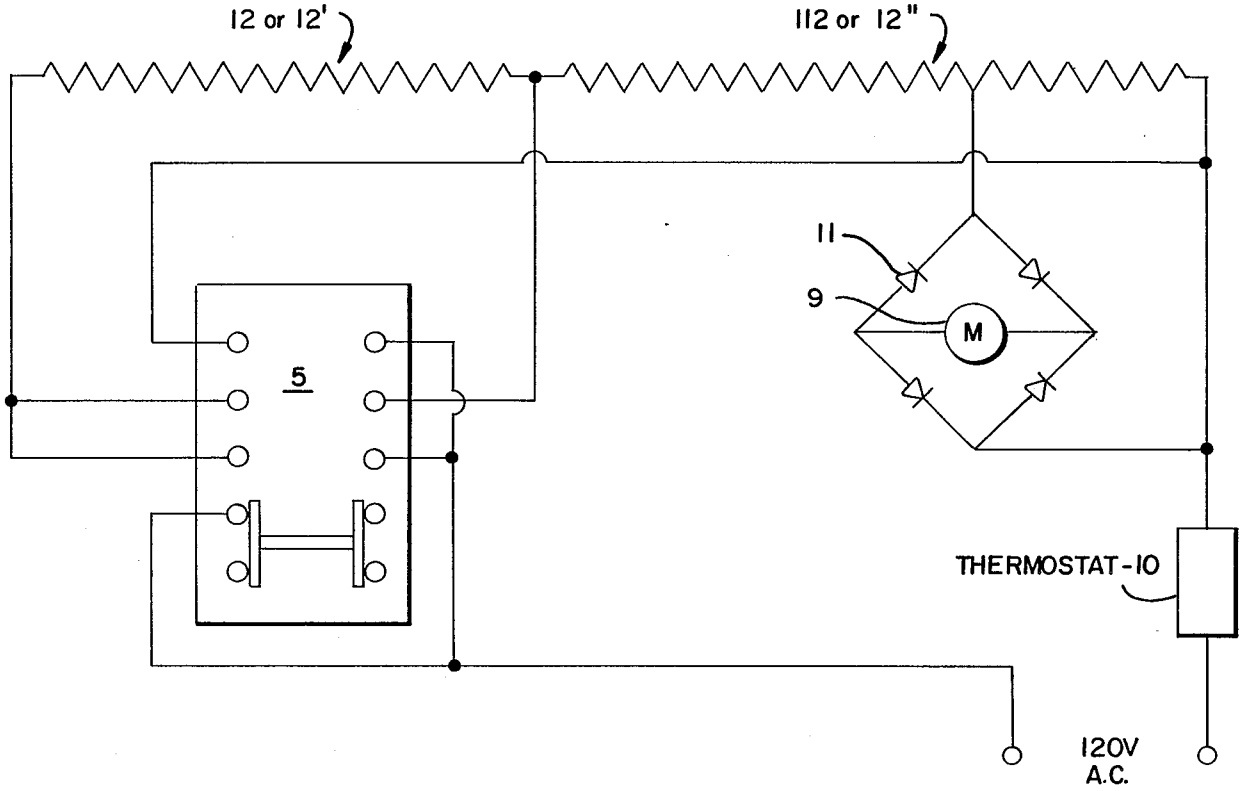
FIG. 5 is a circuit diagram showing the two heater elements.

The heater according to FIG. 4 comprises an outer cage 12 mounted on two end rings 13 and 13', which is identical with the cage illustrated in FIG. 1, and an inner cage 112 mounted on two end rings 113 and 113', all of an outer diameter smaller than the inner diameter of the end rings of the outer cage. Each resistor cage is separately connected to a switch 5 in the handle, which is provided with two or three contacts, permitting energizing either of the cages separately or both cages together noting the circuit diagram in FIG. 5.

It will be understood that the afore-described embodiments represent only examples of the hair dryer of the invention and that alternative and modified embodiments may be made by a person skilled in the art, while maintaining the principle of having the electric motor extending into the heater cage and causing a flow of cool air to pass through the nozzle-shaped annular space 26 and to create a low pressure zone to help draw in the air through the heater cage.

I claim:

1. An electric hair dryer comprising an elongated casing of circular cross section having a rear end perforated by air inlet ports and a front end perforated by air outlet ports, said casing containing:

an electric motor having a rearwardly extending shaft, a motor cradle supporting said motor, an axial fan impeller on the shaft of said motor, an electric heater element in the shape of at least one hollow cylindrical open-ended cage comprising a plurality of parallel, spaced-apart, electrically heatable metal strips connected in series at alternate ends by bridging portions, said strips being inclined to the ideal circumference of said at least one cage, so as to form air guide vanes;

said at least one cage having its ends facing the front and rear ends, respectively, of said casing, and being mounted on end rings of a non-conductive material;

and electric switching and controlling means carried by said casing and operatively connected to the at least one heater element and to said motor for controlling energization thereof;

the hair dryer being characterized by the front portion of said casing tapering towards its front end;

that said electric motor is of smaller diameter than said cage and partly extends into the inner space of said cage;

that said impeller is mounted on the rearwardly extending shaft of said motor upstream of said cage;

that said at least one cylindrical cage is positioned said casing in coaxial alignment therewith and between said casing and said motor thereby creating an outer annular space between said casing interior and said at least one cage having a cross section gradually decreasing towards the front of said casing where it is closed by contact of said front end ring with the inside of said casing, thus forming a duct for conveying a portion of the air delivered by said impeller through said heated air guide vanes of said at least one cage into said at least one cage interior, and forming an inner space between said at least one cage and said motor for conveying the remaining air volume direct into said at lease one cage interior, while cooling said motor surface; and that said motor is located inside said at least one cage in a manner creating a space downstream of said motor for mixing the air volume heated by passage through said heated strips of said at least one cage with the cooler air volume conveyed through said inner space.

2. The hair dryer of claim 1 wherein said heater element in the shape of two separate cages of identical diameter and of relatively short length mounted in non-conductive alignment on two of said end rings and on one common central ring, said switching and controlling means including means for alternatively energizing each of said cages separately and both cages in parallel.

3. The hair dryer of claim 1 wherein said heater element comprises an outer cylindrical cage and an inner cylindrical cage of smaller dimensions positioned inside said outer cage, said switching and controlling means including means for alternatively energizing each said cage separately and both said cages in parallel.

4. The hair dryer of claim 1 wherein said casing comprises a shell tapering from its rear towards its front, and said at least one cylindrical cage is positioned in said casing with its front end ring in contact with the inside of the front end of said shell and with its rear end remote from the inside of said shell, thereby forming said outer annular space therebetween.

5. The hair dryer of claim 1 wherein a safety thermostat is mounted on said motor cradle, and is arranged to interrupt the current supply to said heater element as soon as the air flowing along said cradle is heated beyond a predetermined safe temperature.

6. The hair dryer of claim 1 wherein said inner space between said at least one cage and said motor is in nozzle-shape for effecting a low-pressure zone inside said cage.

7. The hair dryer of claim 1 wherein said motor cradle is provided with outwardly extending ribs.

* * * * *